United States Patent [19]

Foss

[11] Patent Number: 4,922,657

[45] Date of Patent: May 8, 1990

[54] LOCKING SLIDE FOR TILT-OUT WINDOW BALANCE SYSTEM

[75] Inventor: Robert E. Foss, Bellville, Ohio

[73] Assignee: Eastern Balance Corporation, Mansfield, Ohio

[21] Appl. No.: 404,861

[22] Filed: Sep. 8, 1989

[51] Int. Cl.[5] ..... E05D 15/22

[52] U.S. Cl. ..... 49/181; 49/176; 49/446; 49/454

[58] Field of Search ..... 49/181, 176, 161, 446, 49/454

[56] References Cited

U.S. PATENT DOCUMENTS

| | | | |
|---|---|---|---|
| 2,006,745 | 7/1935 | Polson et al. | 49/181 |
| 3,135,014 | 6/1964 | Martin | 49/181 X |
| 3,464,160 | 9/1969 | Anderson | 49/181 |
| 3,611,636 | 10/1971 | Trout | 49/181 |
| 4,364,199 | 12/1982 | Johnson et al. | 49/181 |
| 4,644,691 | 2/1987 | Wright | 49/181 X |

*Primary Examiner*—Philip C. Kannan

*Attorney, Agent, or Firm*—Pearne, Gordon, McCoy & Granger

[57] ABSTRACT

A locking slide device for use in a double-hung window assembly wherein one or more sash are adapted to tilt inwardly about a pair of pivot pins located at the lower portion of the sash. The pivot pins are received in carrier slides which are adapted to carry the sash for guided vertical sliding movement, the carrier slides being received in vertical guide channels defined by jamb liners. The carrier slides are also connected to counterbalance means such as helical springs. Each carrier slide has a groove that receives a vertical rib formed in the guide channel and a cylindrical roller with a horizontal axis is carried in a roller slot within the carrier slide for selective movement into locking engagement with the rib. The cylindrical roller is engaged by one of the pivot pins whenever the sash is in its normal vertical position relative to the jamb liners. However, when the sash is pivoted out of the jamb liner, an interference between the sash and the jamb liner forces the jamb liner outwardly, carrying its respective carrier slide away from the pivot pin so that the pivot pins free the roller. Accordingly, the rollers are urged into wedging engagement with the vertical rib to lock the slides in a fixed position in the guide channel.

6 Claims, 6 Drawing Sheets

FIG. 7
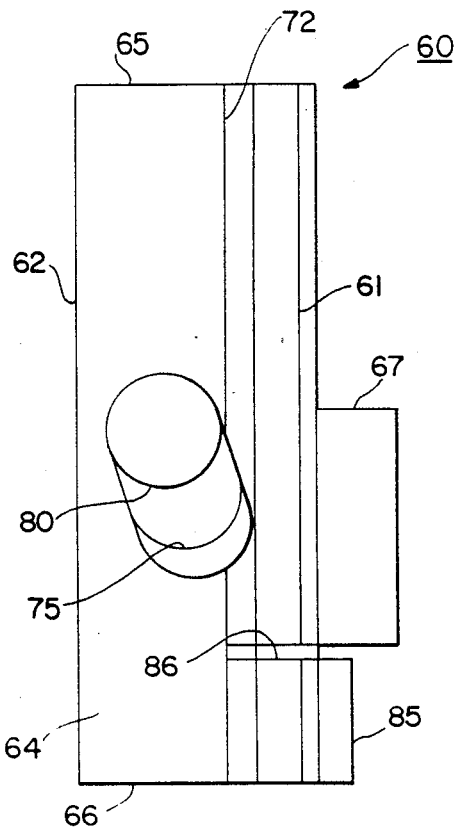
FIG. 8
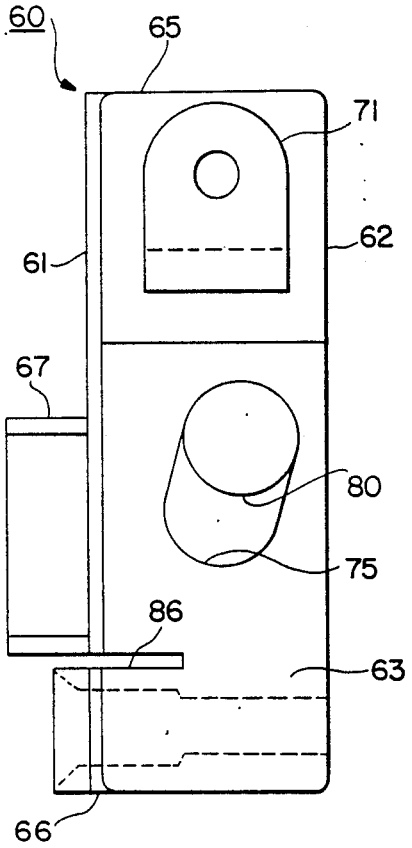
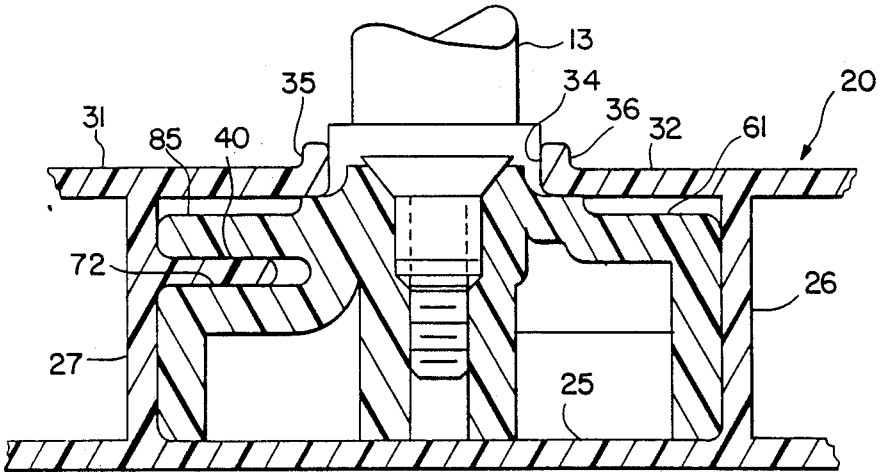
FIG. 9

LOCKING SLIDE FOR TILT-OUT WINDOW BALANCE SYSTEM

BACKGROUND OF THE INVENTION

This invention relates generally to double-hung window assemblies with at least one sash that slides vertically in the window frame and that also tilts relative to the frame about a horizontal axis. More particularly, the invention relates to a device for locking the horizontal pivot axis of the sash in a fixed vertical position during tilting to prevent undesirable upward movement caused by contraction of a counterbalance spring or the like.

In many modern window assemblies, the sash are slidable in combination weatherseal guides or jamb liners that are coextensive with the jambs at opposite sides of the window frame. The jamb liners or guides establish a weatherseal at the edge faces of the window sash, and at the same time provide for free guided vertical movement of the sash. The sash are usually counterbalanced by helical springs attached at their upper ends to the tops of the guides and at their lower ends to slides, which are in turn connected near the bottom of the sash. The sash are provided with pivot means connected to the slides so that they may be tilted inwardly about their lower ends to facilitate washing, for example.

This type of mounting is also adapted to permit removal and replacement of the sash for cleaning, painting and other purposes. The yieldably backed jamb liners permit sufficient lateral movement of the sash to free the end faces from the sashways or guide channels to disconnect the sash from the balance springs. However, when the sash are tilted away from the jamb liners, the sliding friction is substantially reduced, so that the tension or upward force provided by the counterbalance springs exceeds substantially the weight and friction force resisting movement. As a result, the springs tend to fly back and jerk the slides or sash connections violently upward.

Where the slides are provided with a locking means to prevent snap-back, the system used usually includes gripping devices that are intended to set and grip the jamb liners automatically in response to the force of the balance springs when the sash are tilted outwardly or removed. The gripping devices, however, when operated over a long period of time, can cause serious damage to the jamb liners. Typical devices in the prior art used to accomplish this purpose are shown in the following U.S. Pat. Nos.: 2,006,745, 2,989,773 3,135,014, 3,464,160, 4,644,691.

The clutching or braking means shown in these patents generally use sliding members that dig into the walls of the channels housing the springs, with the result that the inner walls soon become so abraded that it is difficult for the sash and slides to travel freely in the channels during the lifting and lowering of the sash. Other prior art devices use rods on the interior of the channel housing with wedging devices slidable on the rods and impinging against the rods to lock the ends of the springs in place. These devices eventually become inoperative because the rods become damaged and the slidable members become struck on the rods and prevent proper functioning of the window balance system.

The apparatus of the present invention resolves the difficulties described above and affords other features and advantages heretofore not obtainable.

SUMMARY OF THE INVENTION

It is among the objects of the invention to provide a locking means for the counterbalance springs in double-hung window assemblies that will lock the slides in the jamb liners when the window is tilted out or removed from the frame.

Another object is to provide a locking means for a window balance system in a double-hung window assembly of the type described which permits the sash to be easily connected and disconnected from the slides without danger of the slides being dislodged during removal or replacement.

Still another object is to provide a locking slide for a double-hung window system of the type described which will automatically engage and lock regardless of the vertical position at which the sash is tilted out or removed from the window frame.

These and other objects and advantages are obtained with the unique locking slide device of the invention. The invention generally comprises a mechanism within an installation that includes at least one window sash in a frame wherein it is supported for vertical movement, and for tilting movement about a horizontal axis. A counterbalancing mechanism generally including helical springs is provided and connected between the frame and the sash to urge the sash to a raised position in order to counterbalance the weight and frictional force resisting upward movement.

In accordance with the invention, the frame includes a pair of fixed vertical jamb liners, each jamb liner defining a vertical slide channel and a vertical rib in the channel that extends perpendicular to the plane of the sash. The sash is provided with a pair of pivot pins secured to opposite sides generally at the lower ends to define a horizontal axis for tilting movement of the sash relative to the frame. Located in each slide channel for the sash is a carrier slide adapted for guided vertical movement, the slide being connected to the respective counterbalance means.

Each slide has a vertical groove adapted to receive the rib that extends into the channel. Also, each slide has a cylindrical roller with a horizontal axis extending parallel to the rib, the roller being mounted in a roller slot communicating with the groove and adapted to accommodate linear movement of the roller perpendicular to its axis and in a plane angularly disposed relative to the rib. The roller is adapted to move in the roller slot between a retracted position at the upward end of the slot and an extended locking position at the lower end of the slot wherein the surface of the roller engages one face of the rib to grip the rib between the roller and the opposite wall of the groove of the slide. Accordingly, the roller, when permitted to move to its extended position, serves to pinch the rib between the roller and an adjacent surface of the slide to lock the slide relative to the rib. Thus, the upward force applied to the slide by the counterbalance means cams the roller against the rib to lock the slide in a fixed position in the channel.

In accordance with one aspect of the invention, the slide is provided with an adjustable brake arm that is adapted to bear against one face of the rib and apply a constant braking force between the slide and the rib depending upon the degree of adjustment.

According to another aspect of the invention, the slide is provided with a ramp that, in cooperation with the respective pivot pin of the sash, provides a camming action so that when the pins are moved with the sash across the ramp surface, the jamb liner is compressed until the pin reaches its seat in the slide and the jamb liner compresses to lock the pin relative to the slide.

According to still another aspect of the invention, the tilting movement of the sash relative to the slide serves to cam the jamb liners outwardly from the sash, which in turn carries the slides outward in their respective channels away from the pivot pins in a manner that frees the locking roller which otherwise is engaged by the respective pivot pin and prevented from moving into engagement with the rib.

BRIEF DESCRIPTION OF THE DRAWINGS

FIG. 7 is a side elevational view of the carrier slide of FIGS. 5 and 6;

FIG. 8 is another side elevational view of the carrier slide of FIGS. 5 and 6;

FIG. 9 is a sectional view taken on the line 9—9 of FIG. 5 and further showing the carrier slide positioned in a channel of one of the jamb liners of the window assembly of FIG. 1;

DESCRIPTION OF THE PREFERRED EMBODIMENT

Figure 1:
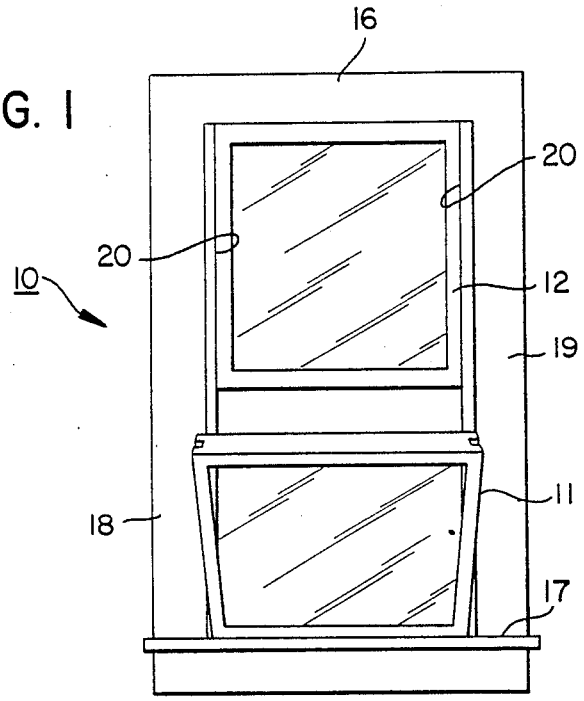
FIG. 1 is a perspective view showing a double-hung window assembly mounted in an exterior wall with one of the vertically slidable sash being tilted outwardly about a horizontal axis so that a major portion of the sides of the sash are separated from the vertical sash guides.
Figure 2:
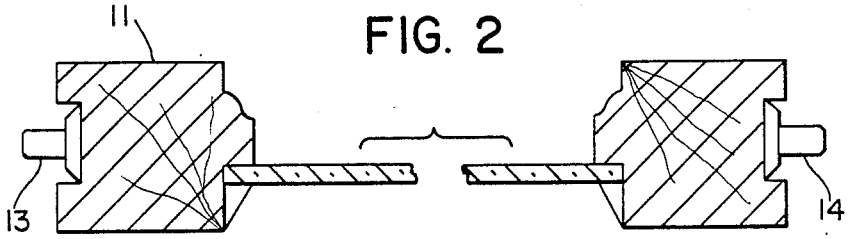
FIG. 2 is a sectional view of the lower sash of the double-hung window assembly of FIG. 1, illustrating the location of the pivot pins.
Figure 3:
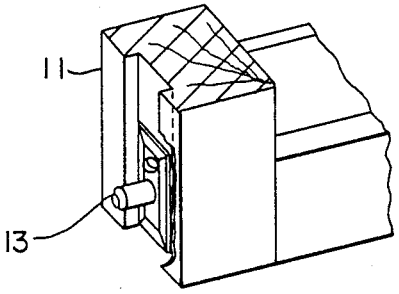
FIG. 3 is a fragmentary, perspective view, illustrating the manner in which one of the pivot pins is connected to a portion of its respective sliding sash.

Referring more particularly to the drawings, FIG. 1 shows a double-hung window assembly 10 with a pair of sliding sash to include a lower sash 11 and an upper sash 12. The sash not only slide between open and closed positions in the window frame, but also are adapted to pivot inwardly relative to the frame. FIG. 1 shows lower sash 11 pivoted inwardly about a horizontal axis defined by a pair of pivot pins 13 and 14 (FIG. 2) extending outwardly from the lower portion of the sash. The sash 11 and 12 are mounted in a frame that includes a header 16, a sill 17, and a pair of vertical jambs 18 and 19.

In accordance with the invention, each jamb 18, 19 is provided with a jamb liner 20 (FIG. 4) of special design and which has an insulation layer 21, preferably formed of compressible foam that bears against the face of the respective jamb. The foam prevents intrusion of outside air, for example, into the heated interior of an enclosed space. Each jamb liner 20 contains a pair of counterbalance assemblies 50 which are connected at their upper ends to a point near the top of the jamb liner and which are connected at their lower ends to one of the slide assemblies 60.

Each slide assembly 60 is received in one of two vertical slide channels 23 and 24 formed in the jamb liner 20. Each channel is defined by a side wall 25 that is in a plane parallel to the side face of the jamb, a forward wall 26 perpendicular to the side wall 25, and a rear wall 27, also perpendicular to the side wall 25 and parallel to the forward wall 26. Extending inwardly from the inner ends of the respective walls 26 and 27 are parallel skirts 31 and 32 that define a vertical opening 34 in the channel.

Extending along the exterior edge of each opening 34 are a pair of ridges 35 and 36 that serve as guides for the sash and for an operative purpose to be described below.

In accordance with the invention, each channel has an inwardly extending rib 40 formed therein that extends from the rearward wall 27 parallel to the side wall 25. The rib cooperates with a unique device in the slide assembly to lock the slide assembly in position in its respective slide channel and in a manner that resists the upward force applied by the counterbalance assembly 50.

Each counterbalance assembly 50 includes an elongated helical spring 51 connected at its upper end to the jamb liner and with an annular loop 53 at its lower end connected to the slide assembly 60.

Each slide assembly 60 has an outer face 61, an inner face 62 that rests against the side wall 25 of the respective channel 23, 24, a side face 63 that rests against the forward wall 26, and an opposite side face 64 that rests against the rearward channel wall 27. Also, each slide assembly has a top face 65 and a bottom face 66. The slide body is preferably formed of a low-friction plastic material.

A projection 67 is formed in the outer face 61 of the slide and is adapted to extend somewhat through the vertical opening 34 in the respective channel. The projection 67 is formed so as to be loosely received in the opening and yet be guided by the edges of the opening during vertical movement of the slide assembly. Formed within the projection 67 and extending into the body of the slide assembly 60 is an opening 68 adapted to receive one of the pivot pins 13, 14.

Also formed in the outer face 61 of the slide assembly is a recess 69 that defines a ramp 70 in a plane angularly disposed relative to the plane of the face 61. The ramp serves to guide the respective pivot pin 13,14 into the opening 68 when a sash 11, 12 is being replaced in the window frame after being removed. The pins 13, 14 cam against the surface of the ramp 70 to force the slide assemblies outwardly and thus compress the jamb liners 20 until the pins reach the openings 68 and become seated therein. When that occurs, the resilient foam or other insulating material flexes back to its natural position to help retain the pins in the slide assemblies 60 and to bring the ends of the pins into a position that prevents locking of the slides.

Figure 4:
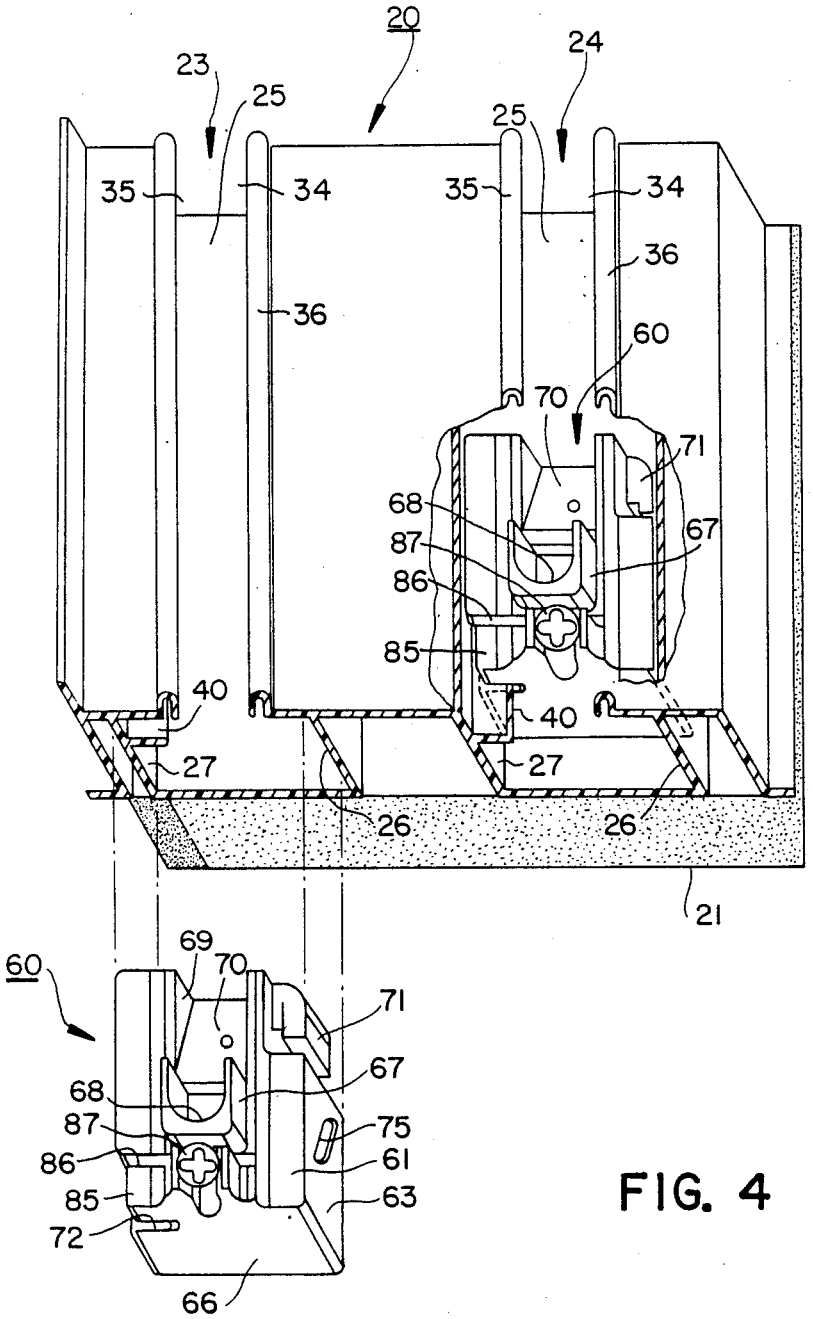
FIG. 4 is a fragmentary, perspective view, partly in section, illustrating the manner in which two carrier slides embodying the invention are mounted in their respective guide channels in one of the jamb liners for the window assembly of FIG. 1.
Figure 5:
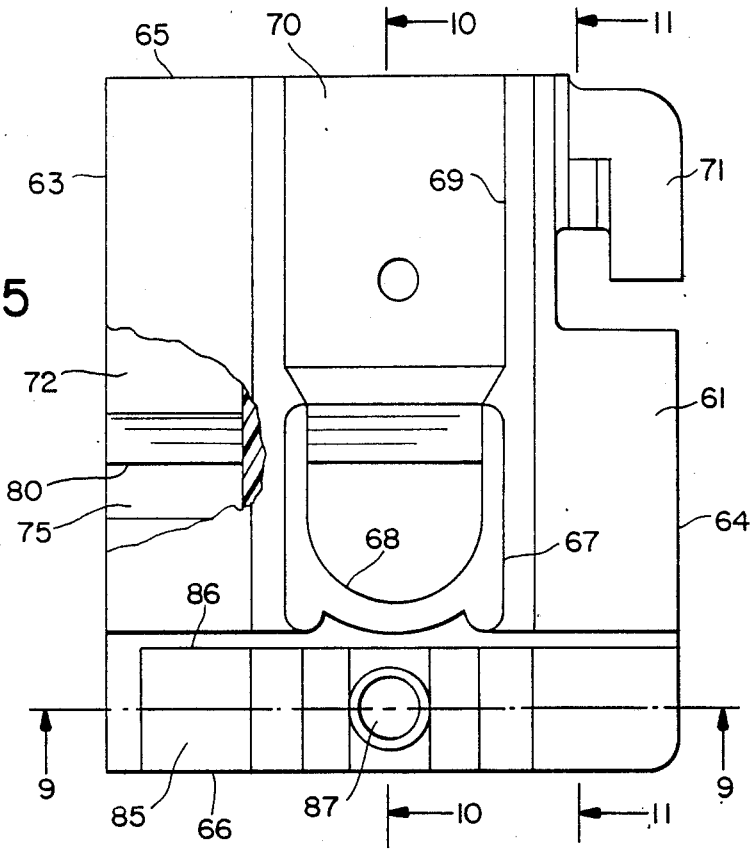
FIG. 5 is an elevational view illustrating one of the carrier slides embodying the invention, with parts broken away for the purpose of illustration.
Figure 6:
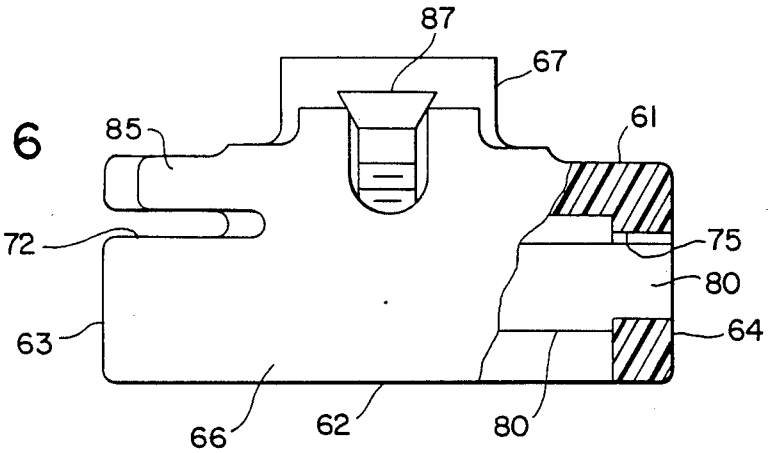
FIG. 6 is an end elevational view of the carrier slide of FIG. 5, with parts broken away and shown in section for the purpose of illustration.

As indicated in FIGS. 4 and 5, a hook portion 71 is formed in the slide assembly to receive the end loop 53 of the helical spring 51 so as to connect the spring to the respective slide assembly.

In accordance with the unique locking mechanism of the invention, each slide assembly 60 is provided with a transverse roller slot 75 that extends horizontally through the slide assembly from the outer face 61 to the inner face 62. The roller slot 75 has a race track shape, as viewed in vertical section, with the longitudinal axis of symmetry extending at an angle relative to the vertical. The angle shown herein is about fifteen degrees.

Received within the roller slot 75 is a cam roller 80 with a radius just slightly smaller than the radius of the semicircular ends of the slot 75. The roller is adapted to move in the slot between an upper position illustrated in FIGS. 7, 8, 10, and 11 a downward locking position illustrated in FIG. 12.

Also formed in the slide assembly is a deep, vertical groove 72 extending the entire height of the slide and formed in the side face 64. The groove is adapted to receive the rib 40 that extends into the respective channel 23,24. The roller slot 75 intersects at its lower end one side of the groove 72, and thus communicates therewith. Accordingly, when the slide assembly 60 is assembled in its respective channel, and when the roller 80 moves to its extended operating position, it engages the side of the rib 40 so that the rib is pinched between the roller and the opposite side of the groove 72. This achieves a locking effect by which the slide 60 grips the rib 40 in a locking fashion to prevent vertical movement of the slide and the respective sash.

Figure 10:
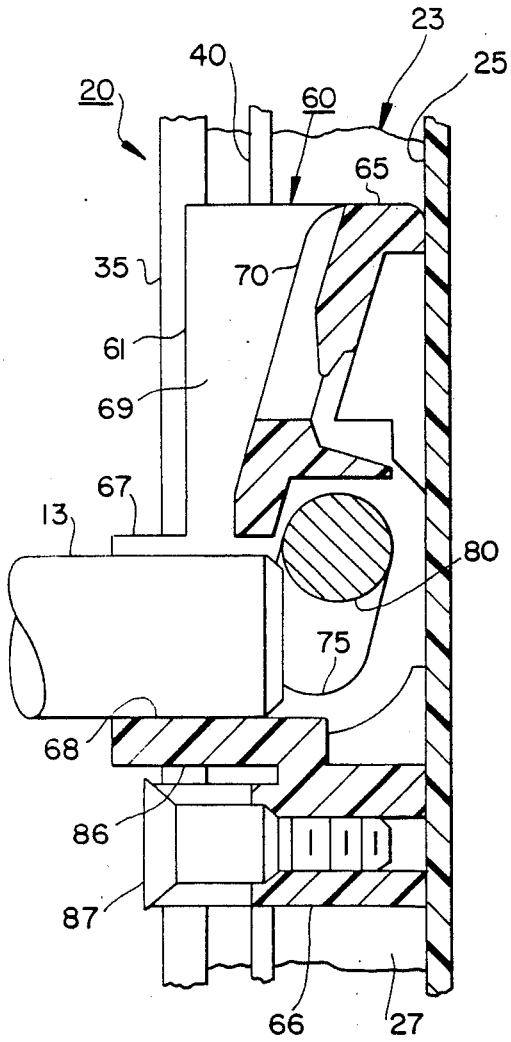
FIG. 10 is a sectional view taken on the line 10—10 of FIG. 5, showing the carrier slide as mounted in one of the channels of a jamb liner of the window frame.
Figure 11:
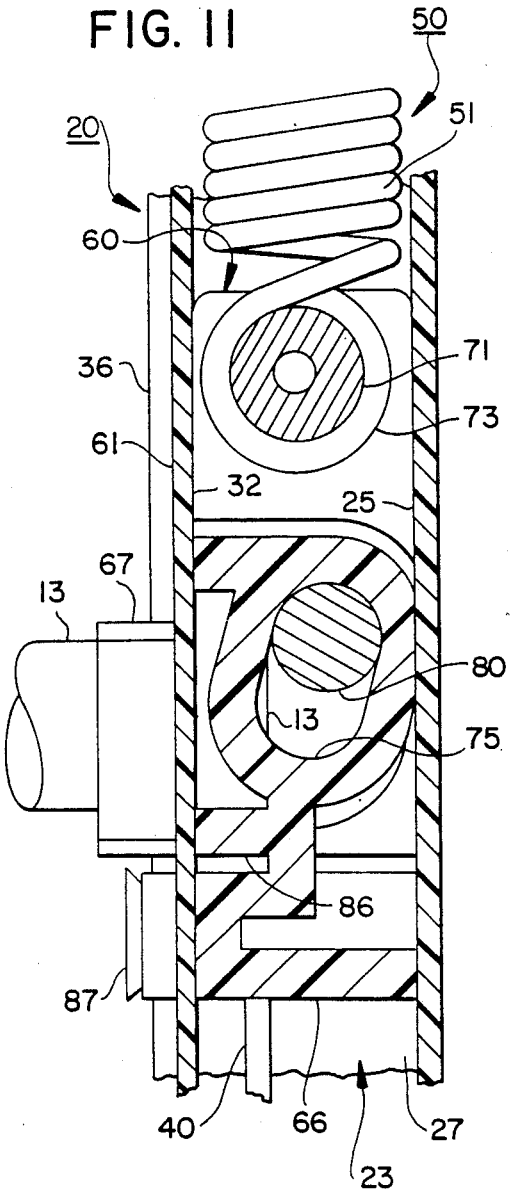
FIG. 11 is a sectional view taken on the line 11—11 of FIG. 5, also showing the carrier slide mounted in a channel of the jamb liner of the window frame.

Referring to FIG. 10, it will be seen that when the sash 11 is mounted in a vertical position in the respective jamb liners 20, the respective pivot pin 13, 14 extends through the opening 68 slightly into the roller slot 75 so that its inner end prevents the roller 80 from moving to its downward position. Thus, so long as the window sash 11 is in a vertical position in the frame, with its sides received in the respective jamb liner 20, the locking action will not occur because the roller 80 cannot move into engagement with the vertical rib 40.

When, however, the sash is tilted outwardly, the ridges 35, 36 that extend along the outer face of the jamb line on opposite sides of the vertical opening 34 are forced away from the sash by the sides of the sash, and thus compress the insulating layer 21 located between the jamb liner 20 and the jamb 18, 19. This action forces both the jamb liner 20 and the respective slide assembly 60 away from the sash 11 so that the slide assembly moves axially outward from the respective pivot pin 13, 14. In operation, the pin moves to the position shown in FIG. 11.

Figure 12:
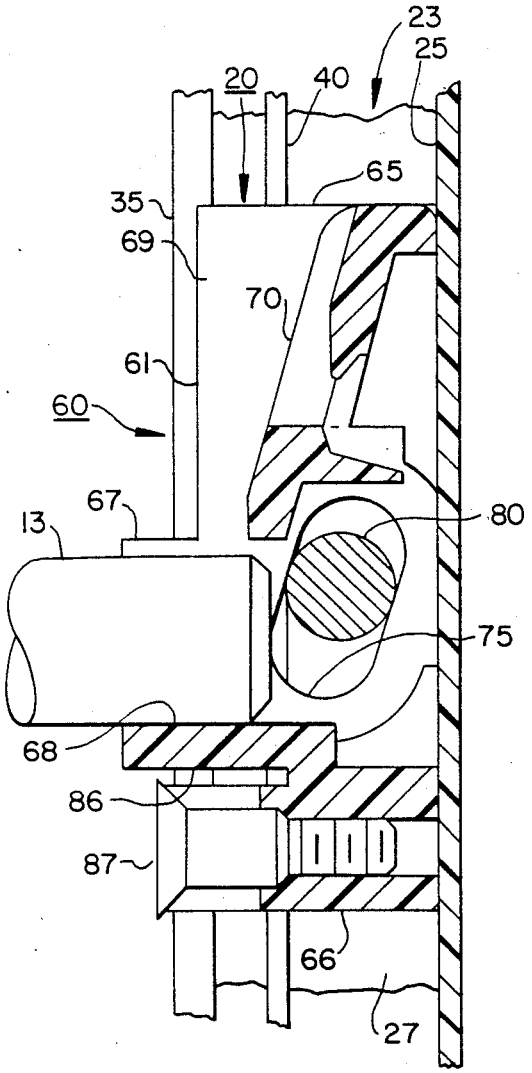
FIG. 12 is a sectional view similar to FIG. 10 showing the respective sash tilted outwardly relative to the window frame and showing the locking device of the carrier slide in its extended locking position to retain the slide in a fixed position in its respective guide channel.

Also, when the sash 11 is pivoted, the friction force between the sides of the sash and the jamb liner is somewhat reduced and the counterbalance springs 51 exert a force more than necessary to hold the sash 11 in its normal counterbalanced position. This action tends to raise the sash 11, its respective pivot pins 13, 14, and respective slide assemblies 60. The result is that the cam rollers 80 move relatively downward and into a camming engagement with the respective surface of the locking rib 40. This causes the respective slide assembly 60 to lock itself to the vertical locking rib 40 and thus resist the upward pull of the counterbalance springs 51. This condition is illustrated in FIG. 12.

On the other hand, when the respective sash 11 is tilted back into its vertical position, with its sides in engagement with the jamb liners 20, the compression force acting against the insulating layer is released, the layer expands, and the respective pivot pins 13, 14 move axially inward through the opening 68 in the slide assembly 60 and into engagement with the roller 80. The initial contact between the ends of the pins 13, 14 with the rollers 80 does not release the rollers from their locked condition. The sash must be moved slightly downward first to disengage the rollers from their locked condition, after which the pins prevent the locking action.

As an additional feature of the invention, the lower portion of the slide assembly 60 is provided with a friction adjusting means so that the sliding friction resisting raising and lowering of the sash 11 can be adjusted. This is accomplished by means of a friction arm 85 that engages the vertical rib 40. The friction arm has a braking face which is essentially parallel to the respective face of the groove 72, although the arm 85 is separated from the adjacent portions of the groove by a cut 86 that permits the friction arm 85 to move independently of the remaining groove face. The friction arm 85 is urged into gripping engagement of varying degrees by means of an adjusting screw 87 that is threaded into a bore 88 that extends horizontally from front to rear of the assembly and which is best illustrated in FIG. 9. As the adjusting screw 87 is tightened down, the conical inner surface of the screw head cams against the face 61 of the slide assembly in a manner that tends to urge the friction arm 85 into tighter engagement with the rib 40.

It will be apparent that the locking slide arrangement of the present invention achieves its locking action without exerting a force against the walls of the channel and without in any way exerting a force that would tend to place the channel under any stress. On the contrary, the gripping action is achieved by means of a vertical rib 40 which has no surfaces forming the walls of the slide channel. With this arrangement, the locking action does not cause any wearing of operating surfaces or any stress or strain that could ultimately cause fatigue and failure.

While the invention has been shown and described with respect to a specific embodiment thereof, this is for the purpose of illustration rather than limitation and other variations and modifications of the specific device herein shown and described will be apparent to those skilled in the art all within the intended spirit and scope of the invention. Accordingly, the patent is not to be limited in scope and effect to the specific embodiment herein shown and described, nor in any other way that is inconsistent with the extent to which the progress in the art has been advanced by the invention.

What is claimed is:

1. In apparatus for supporting a window sash in a frame for vertical movement and for tilting movement about a horizontal axis, the apparatus including counterbalance means connected to the frame and adapted to urge said sash to a raised position, the improvement which comprises:

a pair of fixed vertical jamb liners in said frame, each jamb liner defining a vertical slide channel and a vertical rib in said channel extending perpendicular to the plane of the sash;

a pair of pivot pins secured to opposite sides of the sash to define a horizontal axis for tilting movement of the sash relative to the frame;

a pair of carrier slides, each being received in one of said channels for vertical sliding movement therein and each being connected to said counterbalance means and to one of said pivot pins, each of said slides having a vertical groove adapted to slidably receive said rib, a cylindrical roller having a horizontal axis extending parallel to said rib, means defining a roller slot communicating with said groove adapted to receive said roller and to accommodate linear movement of said roller perpendicular to its axis and in a plane angularly disposed relative to said rib between a retracted position in the upper end of said slot and an extended locking position at the lower end of said slot wherein a cylindrical surface portion thereof engages one face of said rib to grip said rib between said roller and the opposite wall of said groove, and releasable means for selectively retaining said roller in its retracted position, whereby the upward force applied to said slide by said counterbalance means cams said roller against said rib to lock said slide in a fixed position in said channel when said releasable means is released.

2. An apparatus as defined in claim 1, wherein said releasable means comprises said pivot pins, each pivot pin being received in the respective slide and having its inner end extending into said roller slot to engage said roller, and means responsive to tilting movement of said sash for retracting said pin in an axial direction from said roller slot whereby said roller moves into locking engagement with said rib.

3. An apparatus as defined in claim 2, wherein said means for retracting said pivot pin from said roller slot comprises projecting means on said jamb liner extending vertically adjacent the respective sash and protruding inwardly beyond the side edge of the sash whereby when the sash is tilted the sash forces the projecting means outwardly toward the frame along with the respective carrier slide whereby the slide moves in an axial direction away from the pivot pin.

4. An apparatus as defined in claim 1, further including friction adjusting means operatively associated with said rib for adjusting the sliding friction between said rib and said carrier slide.

5. An apparatus as defined in claim 4, wherein said friction adjusting means comprises a friction arm formed integrally with said carrier slide and adapted to engage one side of said rib, and means for varying the force urging said arm against said rib.

6. An apparatus as defined in claim 5, wherein said means for varying the force of said arm comprises a screw mounted in said carrier slide and having a frustoconical shaped head portion that cams against the rearward portion of said arm to urge said arm with increasing force as said screw is threaded into said slide.

* * * * *